United States Patent [19]

Chen

[11] Patent Number: 4,511,274

[45] Date of Patent: Apr. 16, 1985

[54] LOOSELEAF BINDER ASSEMBLY

[76] Inventor: Ted Chen, 11060 - F Artesia Blvd., Cerritos, Calif. 90701

[21] Appl. No.: 513,639

[22] Filed: Jul. 14, 1983

[51] Int. Cl.[3] ..... B42F 13/06; B42F 3/04; B41L 3/06

[52] U.S. Cl. ..... 402/21; 402/19; 282/29 R

[58] Field of Search ..... 282/29 R; 402/19, 20, 402/21, 52, 501, 14, 18

[56] References Cited

U.S. PATENT DOCUMENTS

| | | | |
|---|---|---|---|
| 14,442 | 3/1948 | Hale | 402/21 |
| 2,489,706 | 5/1945 | Emmer | 402/21 |
| 4,374,627 | 2/1983 | Friedman | 402/21 |
| 4,429,901 | 2/1984 | Clery, Jr. et al. | 402/19 |

FOREIGN PATENT DOCUMENTS

| | | | |
|---|---|---|---|
| 694040 | 6/1940 | Fed. Rep. of Germany | 402/21 |
| 834090 | 11/1938 | France | 402/19 |
| 993616 | 6/1963 | France | 402/20 |

*Primary Examiner*—Paul A. Bell
*Assistant Examiner*—Paul M. Heyrana, Sr.

[57] ABSTRACT

A looseleaf binder assembly consisting of a backbone member and a second member that has fastened thereon a plurality of resilient rounded fingers in a position that will accept a plurality of loose sheets is disclosed. The second member contains an inwardly facing continuous flange on the body of the second member and inwardly facing tangs on the end of each resilient finger. These tangs and continuous flange slide into the grooves of the backbone member until each member is substantially aligned. The two members lock in position, when in alignment, by two of the resilient fingers snapping into notches in the grooves of the backbone member. In order to remove the looseleaf sheets, the two resilient fingers are deflected outwardly to allow the two tangs to clear the two notches where the continuous flange of the second member and the remaining tangs on the resilient fingers can slide out of the grooves in the backbone member.

7 Claims, 8 Drawing Figures

FIG. 1
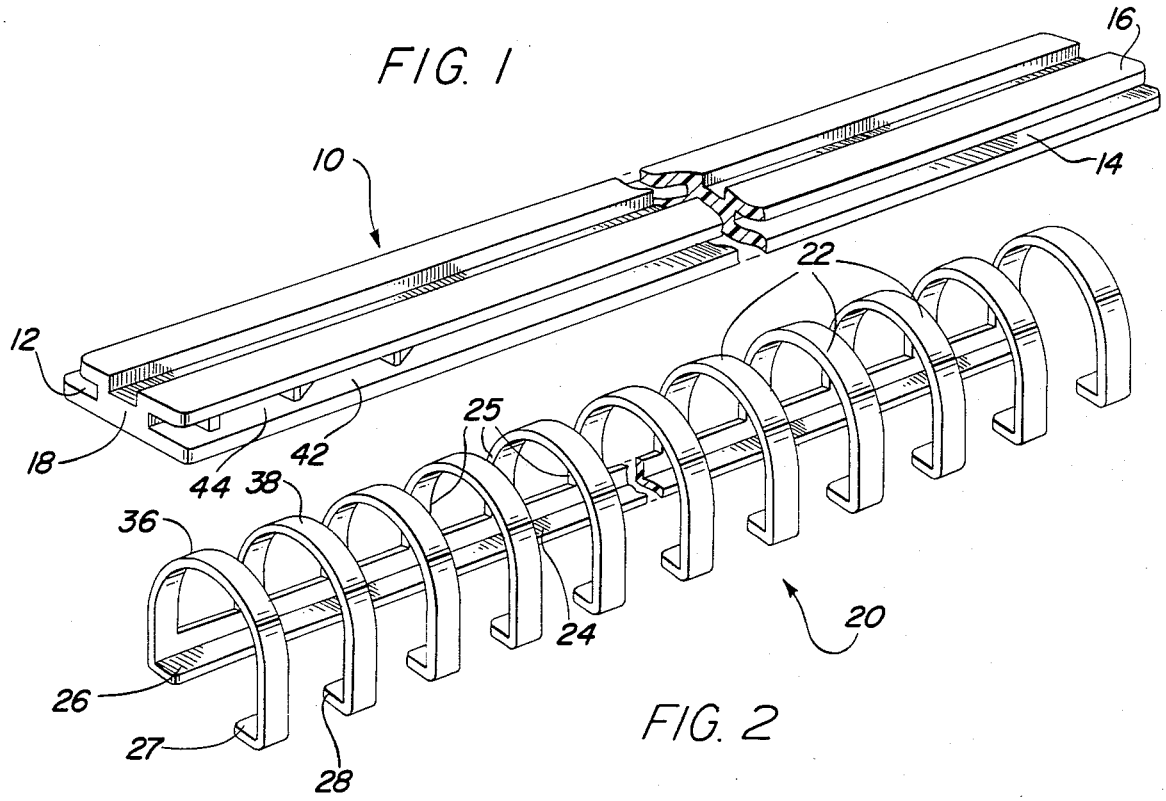
FIG. 2
FIG. 3
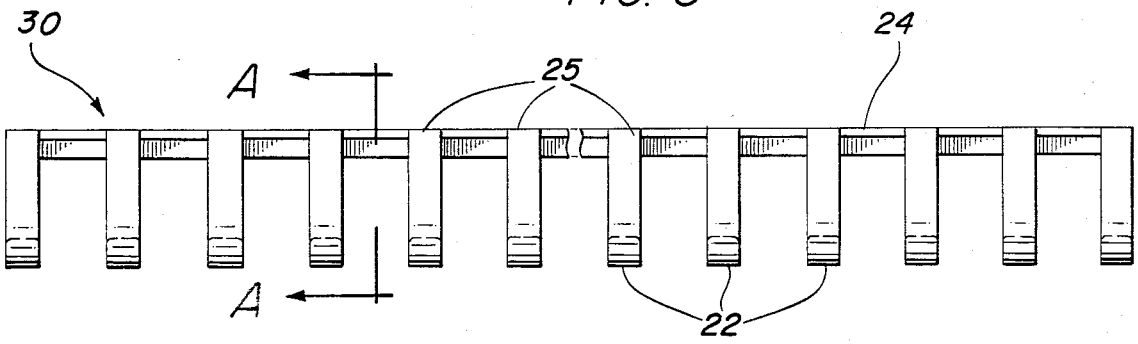
FIG. 4
A-A
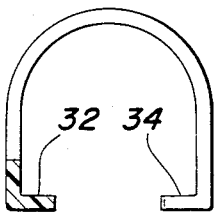

B-B

C-C

LOOSELEAF BINDER ASSEMBLY

BACKGROUND OF THE INVENTION (a) Field of Invention

The present invention relates to looseleaf binder assemblies and more particularly to a two-piece looseleaf binder assembly.

(b) Description of the Prior Art

Looseleaf binder rings and binder assemblies are formed in a variety of configurations; the most typical being the conventional metal binder ring assembly utilizing a spring and a cam mechanism for holding the metal ring in the open and closed positions. Such assemblies are relatively complex to manufacture and therefore are relatively expensive. As a standard, looseleaf paper is manufactured primarily with three (3) holes to fit in a standard three (3) ring binder. With continued use the paper tends to pullout of the binder since the area around the holes in the paper will pull or rip out with continued use. The pullout problem can be improved by increasing the number of rings in the binder but this would add to the expense of the binder. Others have tried to reduce the cost of the metal binders by making a three (3) ring binder out of plastic. Two such patents are U.S. Pat. Nos. 3,954,343 and 4,130,368. Instead of making the binders less complex and therefore less expensive, a complex cam mechanism must be used in each case to open and close rings of the above patents. In addition, the same problem exists with these inventions that exists with the three (3) ring metal binders. That is, with continued use, the paper would also rip or tear out at the hole areas.

A type of binder exists that has multiple resilient fingers which are manufactured from flat plastic stock. The paper is also punched with rectangular holes that fit the flat plastic fingers. This type of binding is called a "binding comb" and can be purchased from several manufacturers such as General Binding Corp., Northbrook, Ill. and Speed-O-Print Co., Chicago, Ill., who also manufacture the punch press and the release device for the specific binding comb. This binder is used for reports where the looseleaf pages are not to be readily removable, however, due to the multiple fingers, the pullout problem is greatly improved. It should be noted that this binder does require the use of hand or machine operated release device that opens all the fingers simultaneously while the pages are being fed on the fingers. If one does not have a release device readily available, it is almost impossible to insert a page or remove a page from a report with this type of binder.

The present invention also uses multiple fingers and therefore the pullout problem is greatly improved. In addition, with the present invention a special device is not required to release the fingers to add or remove the pages of a report.

SUMMARY OF THE INVENTION

It is the object of the present invention to provide a looseleaf binder assembly of multiple fingers to prevent pullout.

It is another object of the present invention to provide a looseleaf binder assembly with multiple fingers that can provide pages to be removed and added without special equipment.

It is yet another object of the present invention to provide a looseleaf binder assembly which is simple in construction and inexpensive to manufacture.

It is a further object of this invention to provide a looseleaf binder assembly which is durable and simple to operate.

Briefly, in accordance with the invention, there is provide a looseleaf binder assembly that contains multiple fingers to provide a strong support to the edge of the pages of a report, yet allow the looseleaf pages to be readily added and removed without a special device or machine that holds all the fingers open simultaneously. The assembly portion that holds the looseleaf pages slides onto a backbone and locks in place when the assembly portion is fully engaged.

Specifically, the backbone has two grooves on each side and the assembly portion that holds the looseleaf pages has a multiple of rounded fingers with an inwardly facing tang on each end. The assembly portion holding the looseleaf pages also has a rigid piece whereby the rounded fingers are rigidly affixed. This piece also has an inwardly facing continuous flange, and along with the tangs on each end of the fingers fit into the grooves on each side of the backbone so that the entire assembly portion containing the looseleaf pages slides into place and locks when the two pieces are in alignment. The locking is accomplished by at least one finger slipping into a notch built into the groove of the backbone. To remove pages in the present invention, two fingers must be simultaneously deflected and the assembly portion containing the looseleaf pages is disengaged by sliding in reverse, from that required by engaging, until the two pieces are free and clear.

The novel features which are believed to be characteristic of the invention, both as to its organization and method of operation, together with further objects and advantages thereof, will be better understood from the following description in connection with the accompanying drawings in which a presently preferred embodiment of the invention is illustrated by way of example. It is expressly understood, however, that the drawings are for purposes of illustration and description only, and are not intended as a definition of the limits of the invention.

BRIEF DESCRIPTION OF THE DRAWINGS

FIG. 1 is a perspective view of the backbone member.

FIG. 2 is a perspective view of the second member.

FIG. 3 is a top view of the second member.

FIG. 4 is a cross section (A—A) of the second member showing the inwardly facing tangs and continuous flange.

Figure 5:
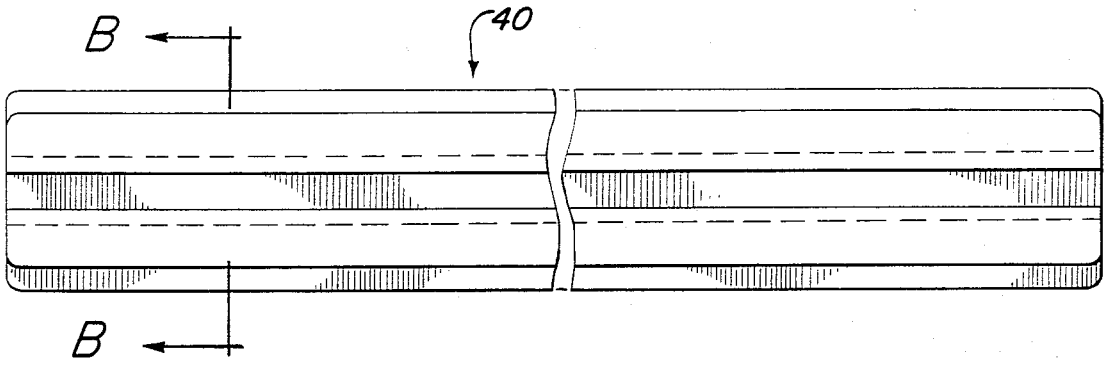
FIG. 5 is a top view of the backbone member.

While the invention will be described in connection with the preferred embodiments, it will be understood that it is not intended to cover all the alternatives, modifications, and equivalents that may be included within the spirit and scope of the invention or described by the appended claims.

DETAILED DESCRIPTION OF THE INVENTION

Referring now to FIG. 1, there is shown a backbone assembly generally indicated as 10. The backbone assembly is comprised of two grooves 12 and 14 fabricated over the entire length of the backbone assembly 10.

FIG. 2 shows the second member generally indicated by 20, the rounded resilient fingers 22 and the means for attaching a portion 24 of the second member 20 rigidly to one end 25 of the rounded resilient fingers 22.

FIG. 3 is a top view of the second member 20 and is generally shown as 30. This view shows a top view of rounded resilient fingers 22 and the portion 24 of the second member 20 that rigidly attaches one end 25 of the rounded resilient fingers 22.

FIG. 4 generally shown as A—A is a cross section of the second member 30 and shows inwardly facing tangs 34 and continuous flange 32. These tangs slide into grooves 12 and 14, respectively of backbone member 10 shown in FIG. 1, when engaging the second member 20 with the backbone member 10. The preferred method of engagement is to slide end 26 of the second member 20 onto the end 16 of the backbone member 10 such that tangs 34 and continuous flange 32 engage grooves 12 and 14 respectively. Second member 20 is then slid in the grooves 12 and 14 until the end 26 of second member 20 is in substantial alignment with end 18 of backbone member 10.

FIG. 5 is a top view of backbone member 10 generally shown as 40.

Figure 6:
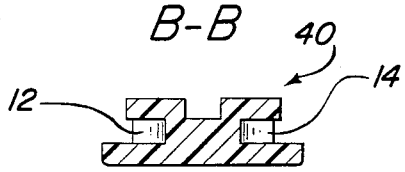
FIG. 6 is a section (B—B) of the backbone member showing the grooves on each side.

FIG. 6 is a cross section view B—B of backbone member 40 and shows grooves 12 and 14.

Figure 7:
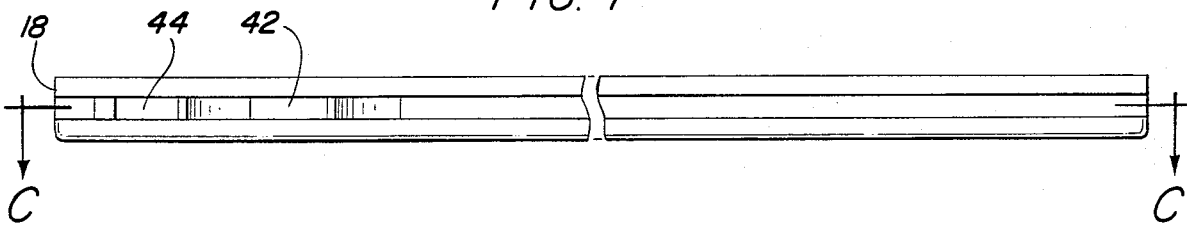
FIG. 7 is a side view showing one end of the backbone member.

FIG. 7 is a side view of end 18 of backbone member 10 showing the two notches 42 and 44 where tangs 27 and 28 lock the second member 20 in position by snapping into grooves 42 and 44 when the second member 20 engages the backbone member 10 and the ends 26 and 18 are in substantial alignment.

Figure 8:
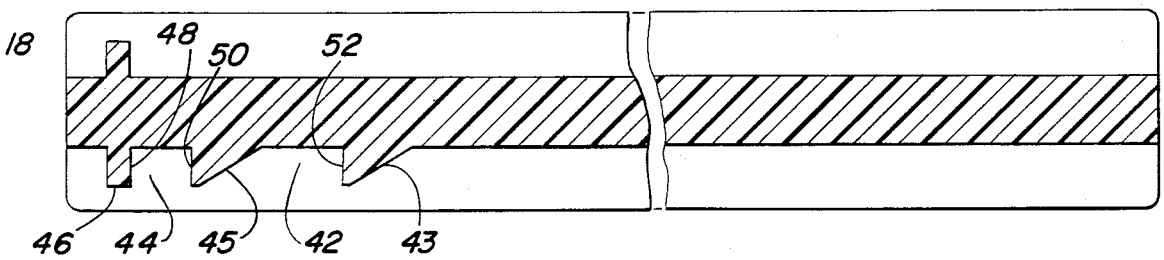
FIG. 8 is a section (C—C) of one end of the backbone member showing the notches which serve as a locking device.

FIG. 8 shows a cross section C—C of the side view of end 18 of backbone member 10. The details of notches 42 and 44 are shown which have ramps 43 and 45 and end piece 46. During the preferred method of engagement, end 26 of second member 20 is fitted on end 16 of backbone member 10 and the inward facing tangs 34 and continuous flange 32 are slid into grooves 12 and 14. Just prior to second member 20 and backbone member 10 becoming substantially aligned, tang 27 first engages ramp 43 and as second member 20 continues to slide in grooves 12 and 14 of backbone member 10, tension builds up in resilient finger 36. When finger 36 reaches notch 42, tang 27 snaps into notch 42. As the second member 20 continues to slide in grooves 12 and 14 of backbone member 20, tangs 27 and 28 simultaneously reach ramp 45 and 43 respectively, whereby tension builds up in resilient fingers 36 and 38 simultaneously. When finger 36 reaches notch 44 and finger 38 reaches notch 42, tang 27 snaps into notch 44 and tang 28 snaps into notch 42. At this point second member 20 and backbone member 10 are substantially aligned and fully locked. It can be seen that stop block 46 keeps second member 20 from sliding further since tang 27 would butt upon face 48 of stop block 46.

In order to disengage second member 20 from backbone member 10, the resilient fingers 36 and 38 must be outwardly deflected simultaneously. Tangs 27 and 28 will then clear the faces 50 and 52 of ramps 45 and 43 when the end 26 of second member 20 is moved toward end 16 of backbone member 10. The resilient fingers 36 and 38 must continue to be outwardly deflected simultaneously as end 26 of second member 20 is moved toward end 16 of backbone member 10. As soon as finger 36 is clear of notch 42, the fingers 36 and 38 may be released. They will spring back to their original position of tangs 27 and 28 fitting into groove 14. Second member 20 then may slide in grooves 12 and 14 of backbone member 10 until second member 20 is free and clear of backbone member 10. When the second member 20 is free and clear of backbone member 10, looseleaf paper may be removed or added to the fingers of the second member 20.

The backbone member may be made from any stiff material such as wood or even lightweight metal, however, to reduce material cost and manufacturing cost, it is preferred to be made out of a suitable plastic that will provide sufficient stiffness for ease of operation. The second member 20 must be made from a material that will provide resilient fingers. The preferred material for this member is a suitable plastic that can be easily molded, provide resilient fingers, and yet be low in material and manufacturing cost.

The preferred embodiment will also employ equally spaced fingers because looseleaf notebook paper is manufactured with equally spaced holes. The spacing of the holes is usually standard throughout the paper industry and the holes are evenly spaced with respect to each other. The preferred embodiment finger spacing and therefore hole spacing is approximately ½ inch. Of course, any variation in finger and hole spacing from the preferred embodiment where tangs 34 and continuous flange 32 of second member 20 will slide smoothly into grooves 12 and 14 of backbone member 10 will be acceptable. Another criteria of finger and hole spacing is the ability to release the two locking fingers 36 and 38 in a smooth operation. If the fingers 36 and 38 to be released are too close, it would become difficult to deflect the fingers with a human hand and unlock the second member 20 from the backbone member 10. If it is desired, the two members 10 and 20 can be manufactured in various lengths to suit a specific requirement. In addition, the backbone member 10 and hence the second member 20 can be made larger or smaller to suit a specific number of looseleaf pages. The variation in size will be determined by comsumer demand.

Thus, it is apparent that there has been provided, in accordance with the invention, a looseleaf binder assembly that fully satisfies the objectives, aims, and advantages set forth above. While the invention has been described in conjunction with specific embodiments thereof, it is evident that many alternatives, modifications, and variations will be apparent to those skilled in the art in light of the aforegoing description. Accordingly, it is intended to embrace all such alternatives, modifications, and varations that fall within the spirit and scope of the appended claims.

What is claimed is:

1. A loose leaf binder assembly for holding a plurality of sheets comprising:

a backbone member having two grooved slots, each groove slot being located on each side of said backbone member;

a second member whose length is sustantially equal to said backbone member with a plurality of rounded resilient fingers with one end of said rounded resilient fingers rigidly attached to a portion of said second member, said portion also having a continuous flange substantially perpendicular to said one end of fingers and facing the unattached end of said rounded resilient fingers, an inwardly facing tang on said unattached end of said rounded resilient fingers, said flange and said tangs cooperatively engaging and sliding into said grooves on each side of said backbone member, such that said backbone member and said second member are in substantial alignment when fully engaged; and means for locking said second member to said backbone member when said second member and said backbone member are in substantial alignment with each other.

2. A looseleaf binder assembly as described in claim 1 wherein means for locking said backbone member and a plurality of said rounded resilient fingers rigidly attached to said second member is by at least two (2) of said rounded resilient fingers that lock said backbone member and said second member when said ends are substantially aligned with each other.

3. A looseleaf binder assembly as described in claim 2 wherein said tangs of at least two (2) of said rounded resilient fingers snap into cooperatively spaced notches in said grooves of said backbone member when said tang of said second member and said tangs of said rounded resilient fingers rigidly attach to said portion of said second member slide into said grooves of said backbone member until said backbone member and said second member are substantially aligned with each other.

4. A looseleaf binder assembly as described in claim 3 wherein at least two (2) of said rounded resilient fingers are adapted to be deflected outward to release said tangs from said notches so that said backbone member and said second member with said rounded resilient fingers rigidly attached to said portion of said second member can unlock and slide completely free of each other.

5. A looseleaf binder assembly as described in claim 1 wherein said rounded resilient fingers are evenly spaced.

6. A looseleaf binder assembly as described in claim 1 wherein said second member and said rounded resilient fingers are made from a plastic material.

7. A looseleaf binder assembly as described in claim 1 wherein said backbone member is made from a plastic material.

* * * * *

UNITED STATES PATENT AND TRADEMARK OFFICE

CERTIFICATE OF CORRECTION

PATENT NO. : 4,511,274

DATED : April 16, 1985

INVENTOR(S) : Ted Chen

It is certified that error appears in the above-identified patent and that said Letters Patent is hereby corrected as shown below:

On the title page add --Attorney, Agent or Firm - Howard A. Kenyon--.

Signed and Sealed this

*Thirtieth* Day of *July 1985*

[SEAL]

*Attest:*

DONALD J. QUIGG

*Attesting Officer* *Acting Commissioner of Patents and Trademarks*